US005947791A

United States Patent [19]

Taylor

[11] Patent Number: 5,947,791

[45] Date of Patent: Sep. 7, 1999

[54] GENDER NEUTRAL DOLL BODY WITH REPLACEABLE PHOTOGRAPHIC FACE

[76] Inventor: Joan Senica Taylor, P.O. Box 321, Railroad Flat, Calif. 95248

[21] Appl. No.: 09/107,167

[22] Filed: Jun. 11, 1998

[51] Int. Cl.[6] ..... A63H 3/12; A63H 3/02; A63H 3/36

[52] U.S. Cl. ..... 446/321; 446/372; 446/391

[58] Field of Search ..... 446/321, 337, 446/369, 372, 390, 391, 395

[56] References Cited

U.S. PATENT DOCUMENTS

| | | | |
|---|---|---|---|
| 1,059,178 | 4/1913 | Lombra | 446/321 |
| 1,425,974 | 8/1922 | Kearney | 446/321 |
| 2,199,049 | 4/1940 | Greenberg | 446/391 X |
| 3,811,220 | 5/1974 | Glass et al. | 446/321 |
| 4,030,240 | 6/1977 | Port | 446/390 X |
| 4,573,940 | 3/1986 | Showers | 446/390 X |
| 4,776,823 | 10/1988 | Hanlon | 446/321 |
| 4,921,459 | 5/1990 | Cook et al. | 446/321 |
| 5,224,895 | 7/1993 | Franz | 446/321 |
| 5,403,224 | 4/1995 | Gintling | 446/321 |
| 5,415,580 | 5/1995 | Ferri | 446/390 X |

*Primary Examiner*—D Neal Muir
*Attorney, Agent, or Firm*—Mark C. Jacobs, Esq.

[57] ABSTRACT

A racially generic, gender neutral doll body that can be transformed into a person specific stuffed doll by the placement of a photographic image insert into the space between the stuffing and a bonnet of said doll body, to thereby cover over the stuffing formerly visible within the opening of the bonnet.

17 Claims, 4 Drawing Sheets

GENDER NEUTRAL DOLL BODY WITH REPLACEABLE PHOTOGRAPHIC FACE

FIELD OF THE INVENTION

This invention relates to a racially generic stuffed doll having a removable fabric face insert, for time-to-time updating.

BACKGROUND OF THE INVENTION

The appeal of dolls to children and adults through the ages is well documented. From the days of King Tut when stone dolls were used, to the present day computer users of Barbie® and Ken® dolls, dolls have been cherished. Ceramic dolls costing into the thousands of dollars as collectibles are readily available.

Dolls are also used for therapy. It is well known that when children are removed from abusive surroundings, that they are often given a doll or teddy bear to ease the transition to a new circumstance. It is believed that items such as dolls, that are suggestive of comfortable situations or persons have this therapeutic restful effect upon the recipient.

One type of doll that can be comforting to both kids of any age and to adults as well is a doll that contains a photographic representation of a loved one. Thus a child will find pleasure in having a representation of himself/herself, another sibling or even an adult member of the immediate family or possibly a favorite aunt or uncle.

Indeed photographic images have been found on dolls previously. As the result of a patent search, applicant became aware of the following patents, none of which anticipates or renders obvious the invention of this application:

| | | |
|---|---|---|
| Wilson | 5,382,187 | January 17, 1995 |
| Gintling | 5,403,274 | August 4, 1995 |
| Mills | 5,515,592 | May 14, 1996 |

There are various problems associated with each of these prior art photographic image containing dolls. For example, one doll has a photosensitive paper face which can be readily destroyed by young children and which could cause illness if ingested. One doll has a thermal image thereon which is difficult to apply. Yet another doll has an unusual shape, that is not readily identifiable by either an adult or a child.

It is an object therefore of this invention to provide a stuffed doll that has an interchangeable photographic face that can be replaced over time.

It is another object of this invention to provide a doll that is safe for children of all ages.

It is yet another object to provide a doll that is racially generic and which has a photograph for a face.

It is a further object to provide a doll whose facial image can be quickly and easily replaced even by a 10 year old.

It is a still further object to provide a doll which while having a photographic face is still soft and cuddly.

It is a yet further object to provide a stuffed doll having a photograph for a face and which has a voice chip therein.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A stuffed doll body that can be made racially generic and gender neutral and which is adapted to be made into a doll upon receipt of a photographic facial image insert that is engageable with the head portion of the doll body, and which image can be replaced from time to time as may be desired.

DESCRIPTION OF THE PREFERRED EMBODIMENT

Figure 1:
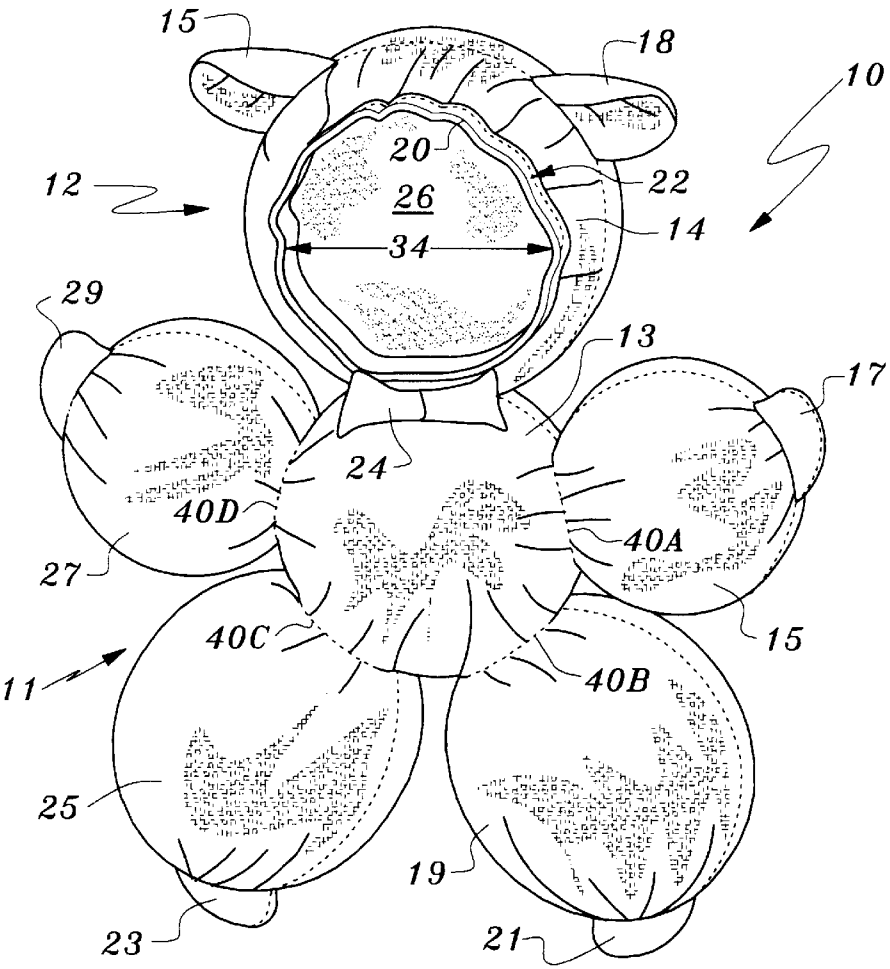
FIG. 1 is a front perspective view of a first racially generic and gender neutral doll body according to this invention.

In FIG. 1 there is shown a stuffed doll, doll body 10 which has a head portion 12 and a body portion 11. The body portion 11 has a thorax section 13, a pair of opposed arm sections 27 and 15 connected thereto at the proximal end of each section, and a pair of spaced leg sections 19 and 25 also attached to the thorax section at their respective proximal ends. Stitching designated 40A, 40B, 40C and 40D denotes the junction of the arm and leg sections to the thorax. See FIG. 1.

Figure 7:
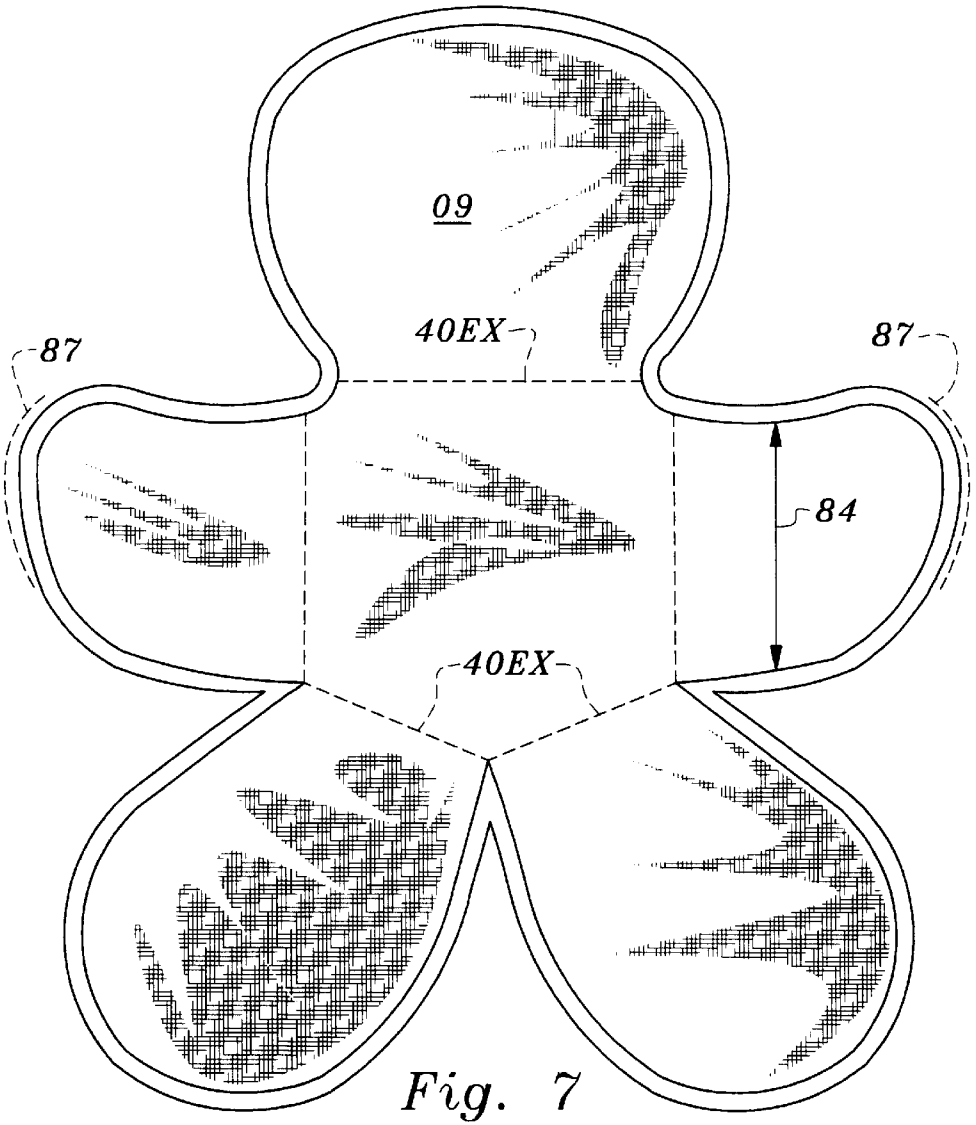
FIG. 7 is an elevational view of one panel utilized in the preparation of the doll of this invention.

At the distal end of each of the arm sections is an upper terminal section 29 and 17 respectively. At the distal ends of each of the leg sections is a lower terminal section, 23, 21. These upper and lower terminal sections somewhat resemble gloves and shoes respectively, but are not intended to be specifically representational thereof. The mode of attachment of each of these upper and lower terminal sections will be discussed infra with respect to FIG. 7 showing one of the body panels 09. Typically these terminal sections may be any color such as pink, blue, green or any other color as may be desired.

Figure 6:
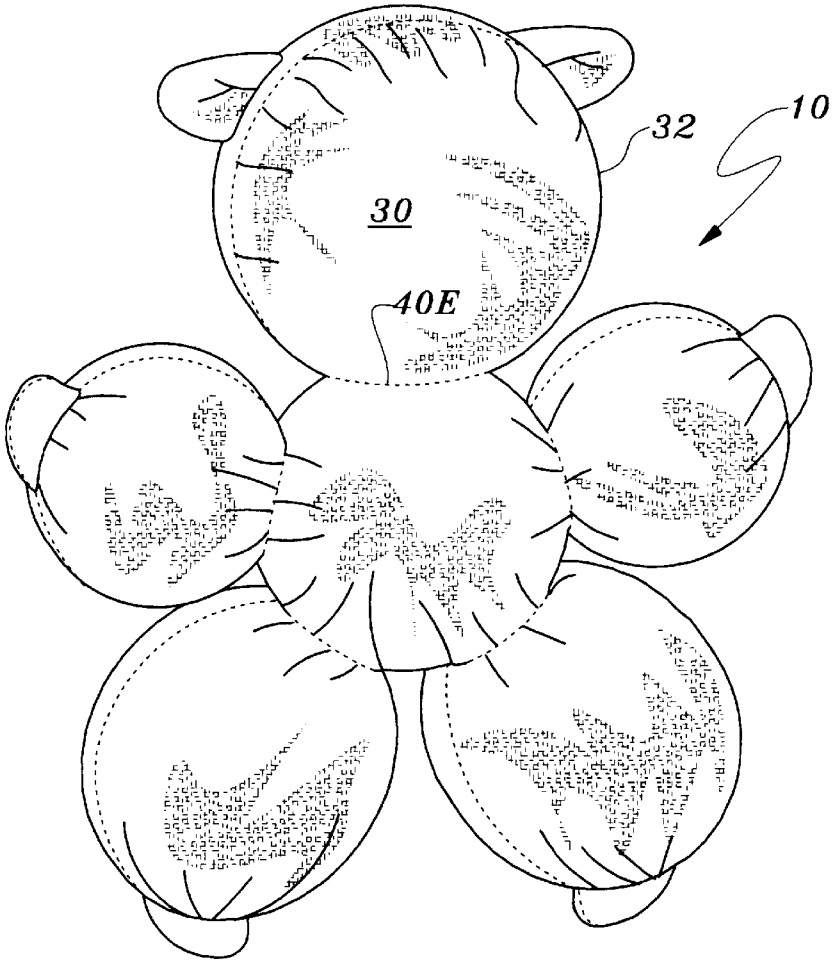
FIG. 6 is a rear perspective view of the first embodiment doll according to this invention.

Head portion 12, comprises a face and head section covered over in part by a rear section 30 stitched along line 40E at the lower edge thereof per FIG. 6 to the thorax section 13. This rear section 30 is a generally flat section of a larger rear panel which section is attached along its periphery to bonnet 14's outer periphery. The bonnet, which also overlays part of the face and head section is a horseshoe shaped section of a front panel, which section is also attached at its lower edges to the thorax, by stitching hidden from view by the decorative optional bow 24. The interior edge of the bonnet 22 is sewn with conventional elasticized thread to folded tape 20 for reinforcement, and serves to define opening 34 which communicates with the stuffing 26 forming the face and head section. See FIG. 1.

It is through this opening that the entire doll body can be stuffed. Thus the stuffing, some of which is seen here, and serves as the face and head section is as noted designated 26 and comprises a member selected from the group consisting of fiberfill, cotton and other conventional materials.

Figure 3:
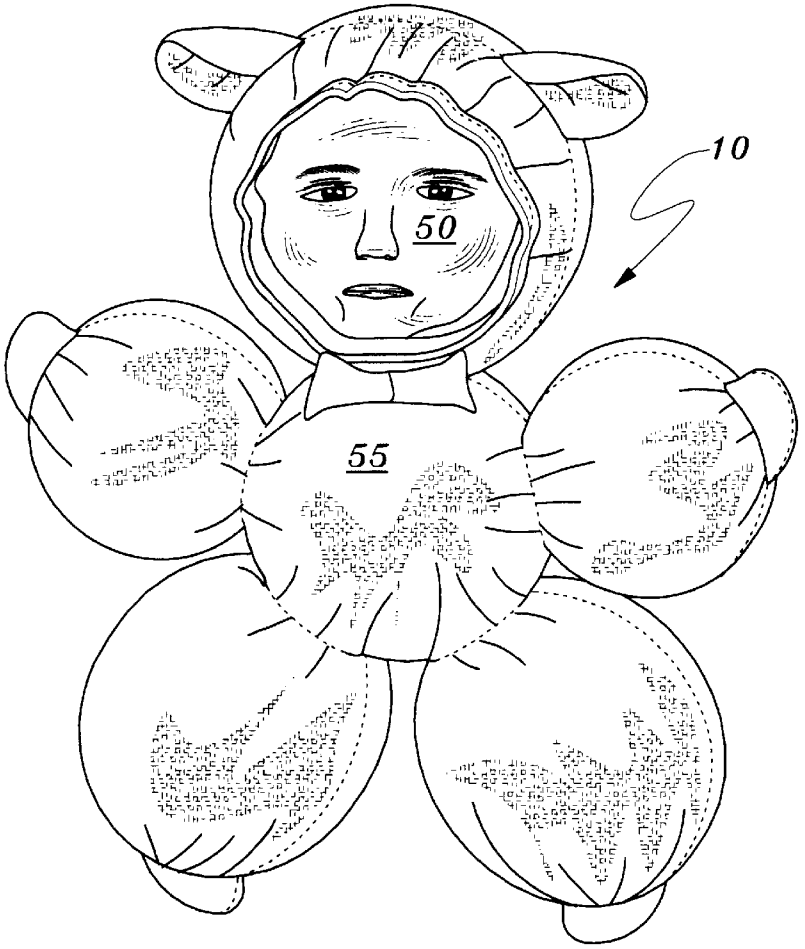
FIG. 3 is a front perspective view of a doll made from the doll body of FIG. 1 shown racially neutral but person specific according to this invention.

(It should be understood that for the purposes of this application a doll body lacks a face to personalize it, as per FIG. 1, while a doll includes a face as per FIG. 3.)

Shown in FIG. 1 are a pair of optional ear trims, 15, 18 which are mere decorative elements and form no part of the invention.

The doll body of FIG. 1 is a racially generic doll and can also be considered gender neutral depending upon the colors used for the fabric for the upper and lower terminal sections, 17, 21, 23, and 29. Thus pink might be considered as a feminine child color, with light blue by convention being deemed a male color. Whereas if the sections are purple or red or green in color, then the doll body would be not only racially generic but gender neutral as well.

Figure 2:
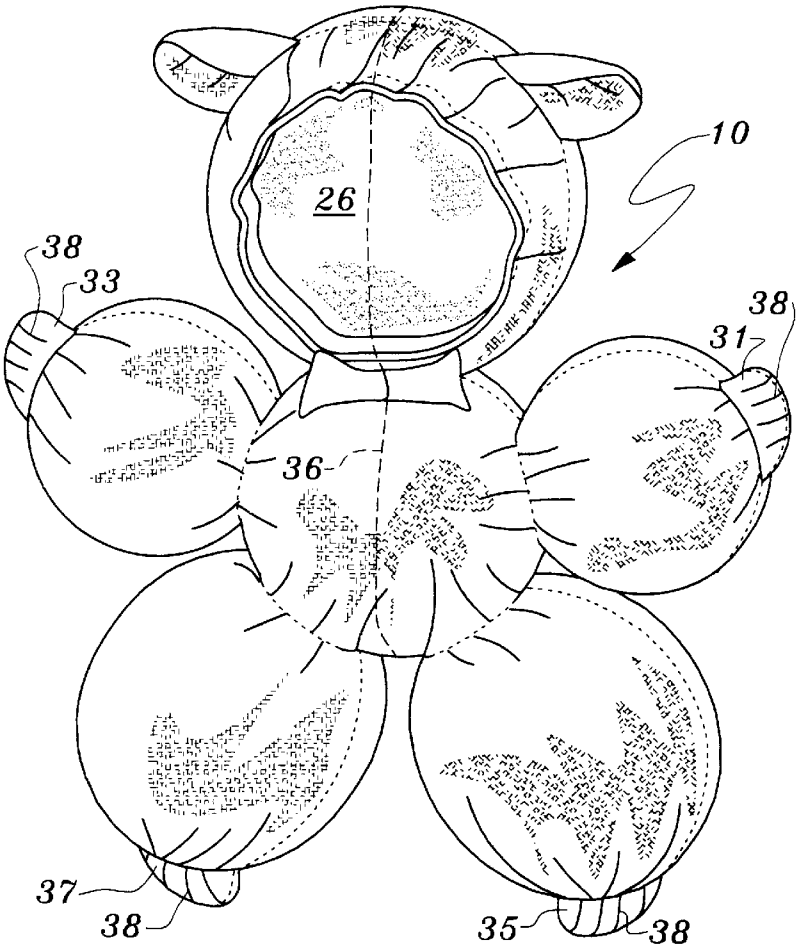
FIG. 2 is a front perspective view of the doll body of FIG. 1, made racially specific but gender neutral.

FIG. 2 depicts a doll body similar to that of FIG. 1, but a doll body wherein the terminal sections do not represent gloves/mittens and shoes. Rather, this doll body is shown with an imaginary bifurcation line 36 such that two different races could be depicted on the same doll body. Thus the left side can be seen to have its terminal sections 33 and 37 colored brown for an African American child, and the right ones 31 and 35 are lined for light orange to illustrate a Caucasian child. In addition, indicia 38 in the form of scribe lines are depicted on the terminal sections to illustrate the presence of fingers and toes. The doll body while racially specific is still gender neutral. All other aspects of the doll body of FIG. 2 are the same as discussed with respect to the doll body of FIG. 1, and so further discussion is needed.

In FIG. 3, the doll body 10, of FIG. 1 has been converted into a stuffed doll 55, by the addition of an insert 50 having a photographic image of a baby face. The necessary procedures on how to carry this out and the details concerning the individual photographic image face will all be described infra.

Figure 4:
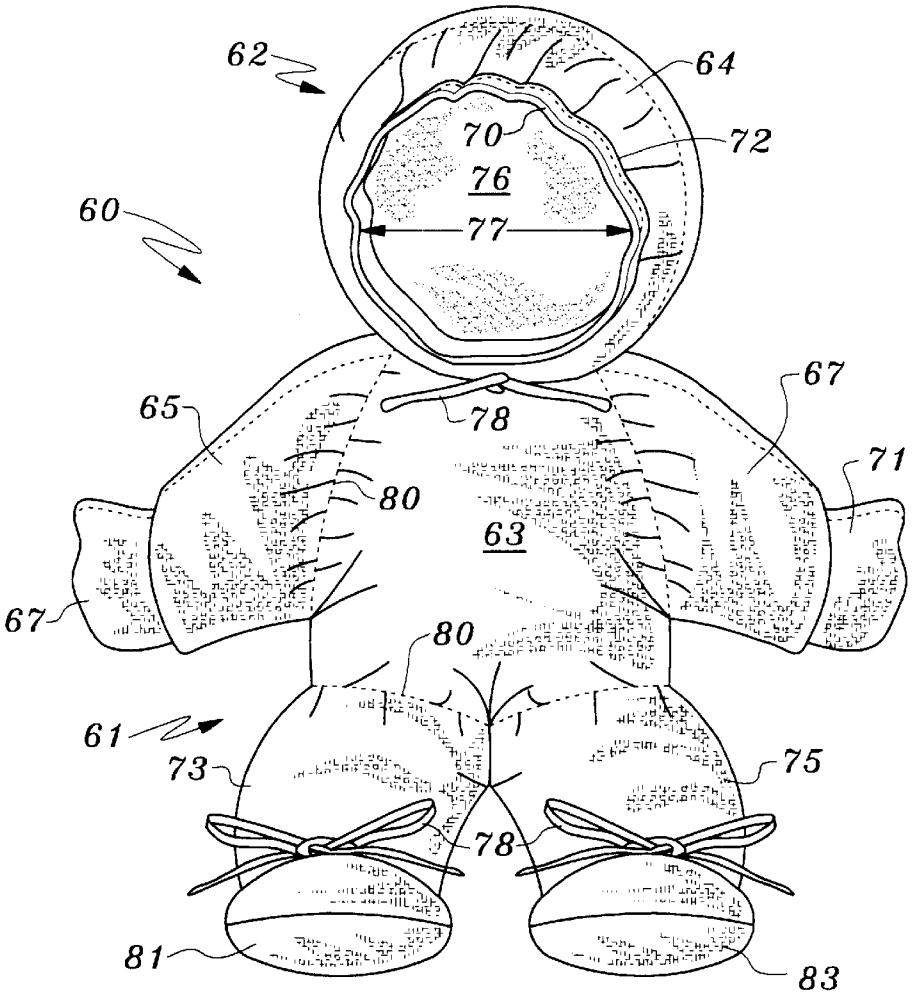
FIG. 4 is a front perspective view of a second racially generic doll body according to this invention.

The discussion now turns to FIG. 4 which depicts a second doll body according to this invention. Here a doll body deemed more masculine by the color and style of the clothes is seen. Doll body 60 has a body portion 61 and a head portion 62. Body portion 61 has a thorax 63 to which are attached at their proximal ends, a pair of opposed arms 65, 67. A pair of legs 73, 75 are also attached at their proximal ends to the thorax. These legs are defined by the elastic thread 80 sewn into the front and back panels which form the body portion 62.

Attached at the distal end of each arm 65, 67 is a hand section 67, 71. These may be made racially generic by making them of fabric colored other than in skin tones, either with or without finger creating indicia, to thereby simulate the presence of either mittens or gloves if done in green, blue etcetera; or racially specific by picking a color to approximate a skin tone commonly found in various parts of the world. See supra on the point of rendering the doll body racially generic.

A two panel hood 64, made in the manner previously described in connection with element 14 of the first doll body embodiment, and similarly attached to the thorax is shown here. Bias tape 70 is stitched to the edge 72 of the hood 64 to thereby leave the stuffing 76 exposed. Trim 78 in the form of shoe laces decorates the hood 64. Stuffing 76 is visible in the opening 77 of the hood 64. The insertion of stuffing into the legs, arms and thorax of the doll body 60 is carried out through the opening in the hood, 77, per FIG. 4. A portion of the stuffing left visible constitutes the face and head section of this doll body.

The lower terminal sections of doll body 60 are in the form of shoes 81, 83. These are seen to be somewhat larger in physical size than the terminal sections 21, 23 of the first embodiment. But they are generally fashioned in like manner and added to slots, and sewn in place prior to the insertion of the stuffing. Here additional lacing trim 78, in the form of shoe laces, has been added for effect. The striping shown on the shoes is for visual effect only and forms no part of the invention. The provision of shoes adds to the concept of racial genericness since the stuffed doll is not seen to be anatomically correct such as to include ankles or knees.

Figure 5:
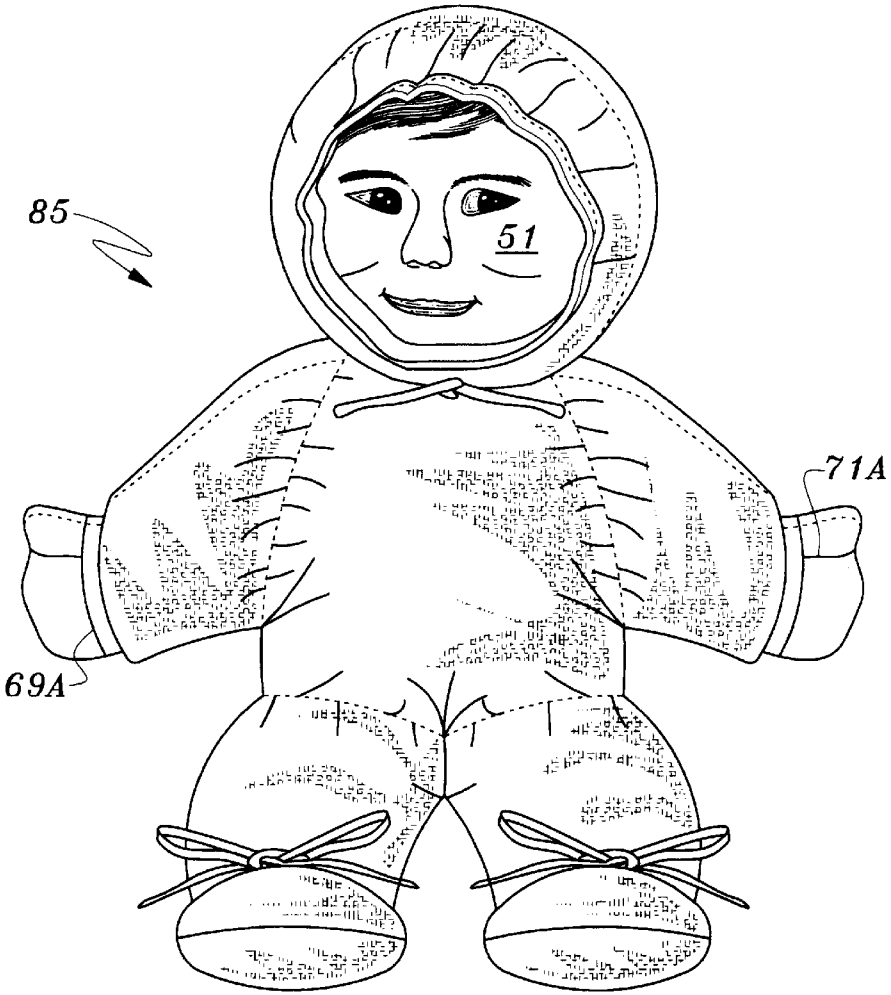
FIG. 5 is a front perspective view of the second doll body embodiment made into a specific person doll according to this invention.

In FIG. 5, the doll body 60 is seen in its converted format as stuffed doll 85 by the application of a different photographic image insert, 51. In all other aspects the doll 85 is similar to doll body 60, save for the specificity of the upper outer extremities, 69 A and 71A which are lined for blue. While lined for blue, there is no criticality to the color chosen. Thus the doll body 60 which had been fashioned into a racially neutral doll by the presence of the mittens as the upper terminal sections, has now been rendered into a male Caucasian doll by the insertion of the photographic image face.

In FIG. 7, the outline of one of the two panels used to form the doll body of FIG. 1 is seen. Panel 09 is one of two flat pieces of cloth that are peripherally sewn together to form the body and head portions of the doll. The one depicted in FIG. 6 is the rear panel. Other than in the provision for the opening in the bonnet of the head section, the two panels are the same. The individual panels for the second embodiment doll could be slightly different in actual dimensions at any particular location, but in general the second doll body substantially resembles the doll body of the first, the primary differences being the trim that forms part of the clothing and the pattern of the cloth. The two doll bodies are converted to stuffed dolls in the same manner as will be described. Obviously other cloth patterns can be employed and no criticality lies in the choice of pattern.

The dotted line 40EX is to designate the locations where the elasticized thread 40 is to be sewn on each panel to define the particular body part of the stuffed doll. See FIG. 1 for example. It is to be understood that the elasticized thread is preferably sewn only onto each one panel separately to create a gathered area to define the arms and legs. The elasticized thread preferably does not join the two panels together. By this construction, all stuffing can be done at one time through the opening in the bonnet.

In the alternative, the two legs of the doll body can be stuffed, and then the elasticized thread used to define the body part and to retain the stuffing for that section of the doll body in place. Both modes of construction are contemplated in this application. Dashed lines 87 indicate where the hands/gloves/mittens are to be joined to the arms sections of the doll.

The upper and lower terminal sections are cut from two individual pieces of cloth, and peripherally sewn together, but for one edge, stuffed with a conventional filler, and then tucked into a slot such as would be left between the two arrows 84 on the panel 09 shown in FIG. 7. This is the preferred mode of assembly as each terminal section is preferably of a different cloth from the balance of the stuffed doll for ease of identification. That is, if hands and/or feet are to be indicated, then plain cloth of a particular color and no pattern would be chosen. If gloves or mittens are contemplated these would be preferably of a different pattern from the rest of the outfit.

Figure 8:
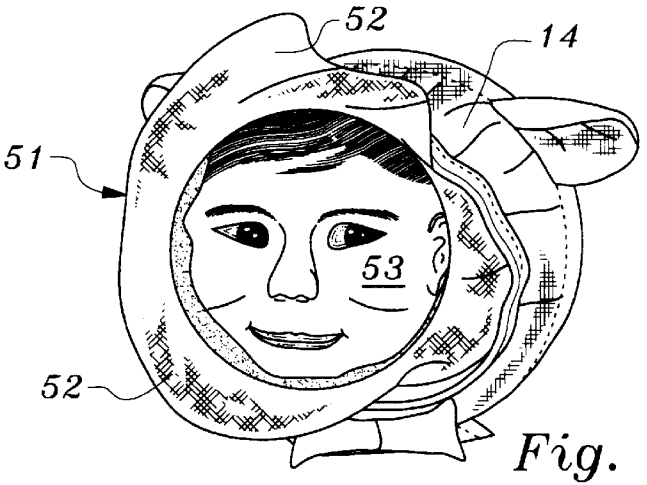
FIG. 8 is a plan view of a photographic facial image insert which forms a part of the instant invention.
Figure 9:
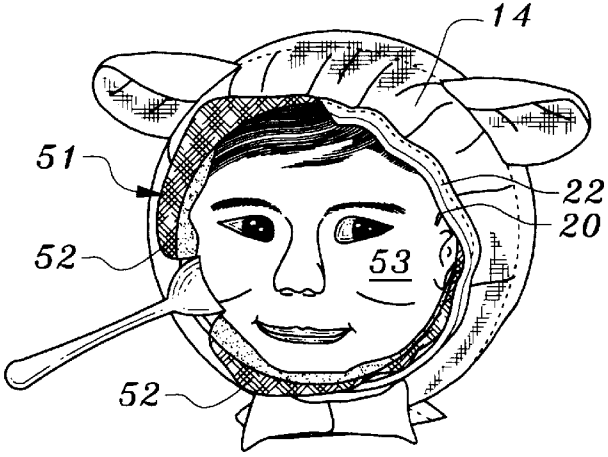
FIG. 9 is a close-up view showing the mode of incorporating the photographic image of FIG. 8 to the doll body of this invention to create a doll.

In FIG. 8 the full photographic image insert 51 is shown. This insert 51, is a soft piece of woven cloth such as muslin, percale or any other cotton, polyester, cotton-polyester blend or other suitable fabric such as linen which is capable of being made into a photographically sensitive substrate for the reception of a photographic image by conventional photo printing techniques as is known in the art.

The doll body such as 10 is converted to a stuffed doll by incorporating an insert 51 into the bonnet 14 of the doll body. The insert 51, is seen to comprise the photographic image 53 and the surrounding non-photo area 52. While a finger 90 is shown accomplishing the task of inserting the surround 52, under the bonnet, just as a little girl might insert her curls under a cap, a flat butter knife or even a spoon end, can be used to accomplish the same thing. That is, one should leave only the photo image showing to personalize the doll body as a doll.

If the doll is to be utilized by younger children, the insert 50 may be tacked into place with a few stitches as is conventionally understood, to prevent accidental removal and/or disposal of the insert by such youngsters.

It is preferred, however, that the insert not be tacked down. That way as the person be it adult or child changes over a period of yours, or the desires of the doll owner change, a new photo can be installed at will for either an updated resemblance of the person invited or a replacement thereof.

When the doll body is stuffed with the stuffing, the material that fills the bonnet is left unattached and merely lays there in place. It is the use of soft stuffing that is unattached to the bonnet that permits the user to thrust the surround section of the insert beneath the bonnet for retention. The gathered area 22 framed by the bias tape 20 acts to secure the image insert into place and this also in turn holds the stuffing on location. Yet the image can be readily removed at will, by pulling out he old insert and replacing it with a new one in the manner set forth earlier.

It is also contemplated within this invention to add an internal electronic music box or sound card that is capable of reproducing a word phrase. Such battery operated devices are readily available in the marketplace from Fibre-Craft Materials Corporation at craft stores everywhere.

It is seen that if a child identifies with a particular doll, that contains his or her own image insert, that the doll can be constantly updated on a periodic basis, by removal and replacement of the image, perhaps every 6 months. Or, if the child is tired of having a doll of Uncle Harry, the doll can be quickly transformed into a doll of Uncle Bill by mere image substitution.

Since the doll bodies of this invention, such as the second embodiment, are of an adult and since it is also contemplated that the dress can be unisex as well as masculine or feminine, an Aunt Mary doll, in some instances could be converted to an Uncle Mark doll, if the clothes of the body were for example blue jeans, and the shirt/blouse a non-gender related color.

Since certain changes may be made in the above described apparatus without departing from the scope of the invention herein involved, it is intended that all matter contained in the above description and in the accompanying drawings, if present, shall be interpreted as illustrative only and not in a limiting sense.

I claim:

1. A racially generic, gender neutral doll body that can be transformed into a person specific stuffed doll, which doll comprises:

a stuffed doll, doll body which doll body has a head portion and a body portion, the body portion of which has a thorax section, a pair of opposed arm sections connected to the thorax at the proximal end of each section, and a pair of spaced leg sections also attached to the thorax section at their respective proximal ends; and the head portion of which, comprises a stuffing face and head section covered over in part by a rear section and a bonnet, said rear section being attached to the thorax section of the body portion, which rear section is also attached along its periphery to, said bonnet, which bonnet has an outer peripheral edge and consists of a horseshoe shaped section which partially overlays the face and head section, and which horseshoe section is also attached to the thorax;

the peripheral edge of said bonnet serves as a receiving area for a photograph serving to define an opening which permits the stuffing to be removed, manipulated or added to, and which opening communicates with the stuffing forming the face and head section.

2. A stuffed doll comprising the stuffed doll body of claim 1 and a photograph of a human face removably inserted between the periphery of the bonnet and the face and head section and retained there between.

3. The stuffed doll body of claim 1 wherein the edge of the bonnet is sewn with conventional elasticized thread to folded tape for reinforcement of the area of the bonnet that defines the opening that communicates with the face and head section.

4. In the racially generic, gender neutral doll body that can be transformed into a person specific stuffed doll of claim 1 wherein stitching denotes the junction of the arm and leg sections to the thorax.

5. In the racially generic, gender neutral doll body that can be transformed into a person specific stuffed doll of claim 1, wherein at the distal end of each of the arm sections there is an upper terminal section and wherein at the distal ends of each of the leg sections there is a lower terminal section, which upper and lower terminal sections somewhat resemble gloves and shoes respectively.

6. In the doll body of claim 1 further including a decorative trim, wherein the horseshoe section is attached at its lower edges to the thorax, by stitching hidden from view by the disposition of said decorative trim.

7. A stuffed doll comprising the racially generic, gender neutral doll body that can be transformed into a person specific stuffed doll of claim 1, wherein at the distal end of each of the arm sections there is an upper terminal section and wherein at the distal ends of each of the leg sections there is a lower terminal section, which upper and lower terminal sections are formed of a specific skin toned fabric.

8. A stuffed doll comprising the doll body of claim 7 and a photograph of a human face inserted between the periphery of the bonnet and the face and head section and retained there between, the racial features of the face being related to the color of the fabric forming the terminal sections.

9. A racially generic, gender neutral doll body that can be transformed into a person specific stuffed doll, which doll comprises:

a stuffed doll, doll body which doll body has a head portion and a body portion, the body portion of which has a thorax section, a pair of opposed arm sections connected to the thorax at the proximal end of each section, and a pair of spaced leg sections also attached to the thorax section at their respective proximal ends; and the head portion of which, comprises a stuffing face and head section covered over in part by a rear section and a hood, said rear section being attached to the thorax section of the body portion, which rear section is also attached along its periphery to said hood, which hood has an outer peripheral edge and consists of a horseshoe shaped section which partially overlays the face and head section, and which horseshoe section is also attached to the thorax;

the peripheral edge of said hood serves as a receiving area for a photograph serving to define an opening which permits the stuffing to be removed, manipulated or added to, and which opening communicates with the stuffing forming the face and head section.

10. A stuffed doll comprising the stuffed doll body of claim 9 and a photograph of a human face removably inserted between the periphery of the hood and the face and head section and retained there between.

11. In the racially generic, gender neutral doll body that can be transformed into a person specific stuffed doll of claim 9 wherein stitching denotes the junction of the arm and leg sections to the thorax.

12. In the racially generic, gender neutral doll body that can be transformed into a person specific stuffed doll of claim 9, wherein at the distal end of each of the arm sections there is an upper terminal section and wherein at the distal ends of each of the leg sections there is a lower terminal section, which upper and lower terminal sections somewhat resemble gloves and shoes respectively.

13. In the doll body of claim 12 further including a shoe lace secured at each of the lower terminal sections respective junction with its leg section.

14. In the racially generic, gender neutral doll body that can be transformed into a person specific stuffed doll of claim 9, wherein at the distal end of each of the arm sections there is an upper terminal section and wherein at the distal ends of each of the leg sections there is a lower terminal section, which upper and lower terminal sections comprise a specific skin toned fabric.

15. In the doll body of claim 1 further including fabric in the configuration of bunny ears attached to the bonnet.

16. A racially generic, gender neutral doll body that has been transformed into a person specific stuffed doll, which doll comprises:

a stuffed doll, doll body which doll body has a head portion and a body portion, the body portion of which has a thorax section, a pair of opposed arm sections connected to the thorax at the proximal end of each section, and a pair of spaced leg sections also attached to the thorax section at their respective proximal ends; and the head portion of which, comprises a stuffing face and head section covered over in part by a rear section and a bonnet, said rear section being attached to the thorax section of the body portion, which rear section is also attached along its periphery to, said bonnet, which bonnet has an outer peripheral edge and consists of a horseshoe shaped section which partially overlays the face and head section, and which horseshoe section is also attached to the thorax;

the peripheral edge of said bonnet serves as a receiving area for a photograph serving to define an opening which permits the stuffing to be removed, manipulated or added to, and which opening communicates with the stuffing forming the face and head section, and a photograph of a child disposed between the peripheral edge of the bonnet and the face & head section and is retained there between.

17. The doll of claim 16 wherein the terminal sections of the body portion are a specific skin tone, and the coloring of the child in the photograph has a similar skin tone to that of the terminal sections.

* * * * *